US005363686A

United States Patent [19]

Hite et al.

[11] Patent Number: 5,363,686

[45] Date of Patent: * Nov. 15, 1994

[54] PROGRESSIVE FORMER

[75] Inventors: William H. Hite; Dennis H. Roush; Stephen G. Corthell, all of Tiffin, Ohio

[73] Assignee: The National Machinery Company, Tiffin, Ohio

[ * ] Notice: The portion of the term of this patent subsequent to Nov. 23, 2010 has been disclaimed.

[21] Appl. No.: 84,368

[22] Filed: Jun. 29, 1993

Related U.S. Application Data

[60] Division of Ser. No. 872,054, Apr. 22, 1992, Pat. No. 5,263,356, which is a division of Ser. No. 692,352, Apr. 26, 1991, Pat. No. 5,138,866, which is a continuation of Ser. No. 459,463, Jan. 2, 1990, abandoned, which is a division of Ser. No. 190,175, May 4, 1988, Pat. No. 4,910,993.

[51] Int. Cl.[5] ..... B21J 13/04

[52] U.S. Cl. ..... 72/455; 72/404; 72/456; 470/166

[58] Field of Search ..... 470/91, 95, 109, 139, 470/117; 29/401.1; 72/456, 455, 362, 368, 404, 482, 483

[56] References Cited

U.S. PATENT DOCUMENTS

| | | | |
|---|---|---|---|
| 3,002,204 | 10/1961 | Cerutti | 10/12 |
| 3,247,534 | 4/1966 | McClellan | 10/27 |
| 3,422,657 | 1/1969 | Grombka et al. | 72/405 |
| 3,508,430 | 4/1970 | Edmondson | 72/456 |
| 3,555,586 | 1/1971 | Wisebaker | 10/12.5 |
| 3,619,013 | 11/1971 | Jones | 308/5 |
| 3,802,247 | 4/1974 | Karsnak | 72/405 |
| 3,807,215 | 4/1974 | Olsen et al. | 72/405 |
| 4,044,588 | 8/1977 | Haines | 72/337 |
| 4,055,869 | 11/1977 | Furuto | 10/25 |
| 4,100,638 | 7/1978 | Fischer | 10/15 |
| 4,631,950 | 12/1986 | Hay et al. | 72/356 |
| 4,694,673 | 9/1987 | Boshold | 72/272 |
| 4,910,993 | 3/1990 | Hite et al. | 72/455 |
| 5,138,866 | 8/1992 | Hite et al. | 72/455 |

*Primary Examiner*—David Jones

*Attorney, Agent, or Firm*—Pearne, Gordon, McCoy & Granger

[57] ABSTRACT

A progressive former and method of producing progressive formers is disclosed in which the bed frame is formed of two side frame members and a spacer member. The two side frame members and the spacer member are substantially fully machined before the side frame members are assembled on opposite sides of the spacer member. Within a given machine size, the side frame members are identical and the width of the spacer member is adjusted to provide the proper spacing between the side frame members for the particular number of work stations in a given machine. By utilizing component parts to produce the machine bed frame rather than a one-piece casting, substantial cost savings are achieved. Further, since the side frame members are identical in machines of a given size having different numbers of work stations, it is economically feasible to produce side frame members for inventory and then assemble them with an appropriate spacer member to provide the desired number of work stations. Similar economies are achieved by utilizing similar kickout drives in timed knockout drives at each work station. The slide and the die breast are laterally located with respect to one of the side members so that tolerance and thermally-induced variations in the spacing between side frame members do not adversely affect the alignment of the slide and the die breast.

4 Claims, 11 Drawing Sheets

PROGRESSIVE FORMER

This is a division of application Ser. No. 07/872,054; filed Apr. 22, 1992, now U.S. Pat. No. 5,263,356, which is a division of application Ser. No. 07/692,352, filed Apr. 26, 1991, now U.S. Pat. No. 5,138,866, now U.S. Pat. No. 5,138,866, which is a continuation of application Ser. No. 07/459,463, filed Jan. 2, 1990, now abandoned, which is a division of application Ser. No. 07/190,175, filed May 4, 1988, now U.S. Pat. No. 4,910,993.

BACKGROUND OF THE INVENTION

This invention relates generally to forging machines, and more particularly to a novel and improved progressive former, and to a novel and improved method of producing same.

PRIOR ART

Forging machines of substantial tonnage have generally provided a one-piece cast iron or steel bed frame which supports a die breast and a reciprocating slide driven by a crank and pitman. Such bed frames have been generally rectangular and structured so that the loads imposed during the forging operations are transmitted directly between the crank and the die breast principally as tensile forces. This has required that the die breast and the crank and slide be mounted within the frame itself. In many such machines, the tools and dies on the die breast and slide cooperate to provide a plurality of work stations and a transfer is provided for progressively transferring workpieces from one work station to the next, so that the workpiece is progressively formed to the desired shape. Such forging machines are generally referred to as "progressive formers" or "progressive headers."

In some such machines, unheated workpieces are formed, and machines for forming unheated workpieces are generally referred to as "cold headers" or "cold formers." Other machines form workpieces which are preheated, and such machines are usually referred to as "hot formers" or "warm formers," depending upon the preheat temperature of the workpiece.

Further, such machines tend to be designated or classed by the diameter of stock which is forged. For example, if a machine is designed to forge workpieces cut from one-half inch rod or wire stock, it is classed as a one-half inch machine, regardless of the number of work stations provided.

Since the size and the strength requirements of the bed frame vary with the given size of a machine, such as a one-half inch machine, depending on the number of work stations provided, it is necessary to design, cast, and machine a different bed frame casting for machines having different numbers of work stations even when a single stock size is involved. Therefore, a variety of bed frame castings are required for each stock size to provide the full range of numbers of work stations to be covered.

Still further, it has generally been the practice to provide different bed frame sizes for machines having different working strokes.

As a consequence, it has been necessary to design, cast, and machine many different bed frames to provide a full line of machines consisting of many different machine structures which tend to be unique, particularly as to machine size and number of work stations. This has greatly increased the cost of the machines.

Further, large, one-piece frames are normally quite complex in shape and are often very large in size. Such complex-shaped, large-sized castings are very difficult to produce with the quality that is required in a forging machine. Large, one-piece frame members are expensive to produce and have a high cost per pound.

Also, large castings are difficult to machine, since many of the machining operations have to be performed on interior surfaces where they cannot be done easily with conventional machine tools. Consequently, it is often very difficult to accurately machine large one-piece frames to close tolerances.

Examples of prior art forging machines of the general type described above are illustrated and described in U.S. Pat. Nos. 3,247,534; 3,422,657; 3,508,430; 3,555,586; 4,044,588; and 4,631,950, all of which are assigned to the assignee of the present invention.

It has also been common practice to equip such machines with the various operating mechanisms required which are specifically designed and constructed for a specific machine. Consequently, it has not been practical in most cases to produce component parts of the machine in sufficient quantity to employ efficient manufacturing techniques. In fact, in most cases the machines are built to order and, because substantially the entire machine must be manufactured after the order is taken, the lead time required before delivery of a machine is quite long. Even in instances in which it can be predicted that a number of machines of a given design can be sold, it has not been practical in most cases to manufacture for inventory because of the extremely high cost of the machines.

SUMMARY OF THE INVENTION

There are a number of important aspects to this invention. In accordance with one important aspect, a progressive former is provided which does not utilize a one-piece frame structure. In accordance with this invention, the bed frame of a progressive former is formed of separate pieces which are capable of being accurately produced at relatively low cost. Cost savings are realized in the production of the bed frame of the machine in several ways. The component parts which are assembled to produce the machine's bed frame are structured so that substantially all of the machining operations which must be performed on the component parts are readily accessible during the machining operation. Consequently, the component parts of the bed frame can be, in most cases, machined on conventional machine tools to very close tolerances without encountering excessive expense.

For example, in the illustrated embodiment, the bed frame is assembled from two side frame members and a spacer member. In such illustrated embodiment, virtually all of the machining operations which must be performed on the side frame members are on exterior surfaces of the side frame member or are accessible from exterior surfaces thereof. Consequently, the machining operations can be performed on conventional machine tools, and can be accurately performed at relatively low cost. Similarly, the spacer member in the illustrated embodiment functions primarily to interconnect the two side frame members and position them in a fixed relationship a fixed distance apart. Therefore, the spacer member, even though it is not completely flat, needs only to be machined to any significant extent along its exposed side edges.

In some instances, as in the illustrated embodiment, the bed frame is assembled from two side frame members formed of steel plate and a spacer formed of steel plate. In such instances, additional savings are achieved because steel plate is much less expensive per pound in most instances than large castings. Further, it is readily available and does not require the lead time of manufacture of large castings. It should be understood, however, that in some instances the bed frame may be assembled of components which are cast, and even assembled, from a combination of castings and steel plate. Therefore, the present invention in its broader aspects is not limited to a machine having a bed frame assembled from steel plate. However, in instances in which the machine can be produced of steel plate, which tends to be less expensive per pound, additional savings are realized.

Further, it should be understood that in some instances where strength requirements cannot be met by component parts formed of available steel plate, it is within the broader scope of this invention to form some of the component parts of two or more pieces of plate which are interconnected. For example, the side frame member within the broader aspects of this invention can consist of two or more laterally abutting plate members which cooperate to produce a single component part of the frame.

Further in accordance with this invention, a substantial portion of the frame for a given size machine, such as a one-half inch machine, is common to all machines within such size range, regardless of the number of work stations required in a particular machine. Consequently, it is practical, and economical in many instances, to manufacture substantial components of the frame for inventory and then to assemble the individual machines to provide any one of several numbers of work stations. In most instances, the material costs are substantially less, and since the components can be used in a larger number of machines, such pre-order production of component parts is feasible and economical.

It is another important aspect of this invention to provide a progressive former having many operating components which are identical, at least within a given machine size, regardless of the number of work stations required in a particular machine. By utilizing identical operating components for a variety of machines, it is economically practical to produce such components in significant quantities for economical production and to maintain the operating components in inventory so that they can be assembled in a particular machine of a given size, regardless of the number of work stations.

For example, in accordance with the illustrated embodiment of this invention, the kickout mechanism for ejecting workpieces from the stationary tooling of each work station is the same as the kickout for other work stations. If the machine has two work stations, two kickouts may be installed. If the machine has more than two, such as six work stations, six similar kickouts may be installed. Similar standardization is provided in other operating mechanisms, in accordance with the present invention.

In accordance with still another aspect of this invention, machines of different strokes within a given size range are provided with frame components which are identical, and also are provided with operating components, most of which are identical. Because the frames are assembled from frame component parts, which are much less expensive per pound than special large one-piece frame members, it is economical to over-design some of the components and build a machine which might be heavier than a corresponding machine formed with a one-piece bed frame.

In accordance with another aspect of this invention, a given size machine, such as a one-half inch machine, is provided with frame side members which have sufficient strength and rigidity to support the load in machines having the maximum number of work stations within the size range, even when the machines in which the frame members are assembled have a number of work stations less than the maximum number of work stations.

In accordance with another aspect of this invention, the drive motor, clutch, and brake are all mounted on one of the side frame members. Further, the feed mechanism is also mounted on the same side frame member. Therefore, changes in the width of the frame assembly required by different numbers of work stations do not require any changes in these components or their mounting.

In accordance with another aspect of this invention, the bearing which laterally positions the slide and the surfaces which laterally position the die breast are on the same side frame member. Therefore, any tolerance variations in the width of the frame assembly do not affect the lateral alignment of these to machine components and accurate alignment of these components is established and maintained. Still further, the bearings are structured so that the weight of the slide creates a lateral bias which tends to maintain the slide in exact lateral position.

These and other aspects of this invention are illustrated in the accompanying drawings, and are more fully described in the following specification.

DETAILED DESCRIPTION OF THE DRAWINGS

Figure 1:
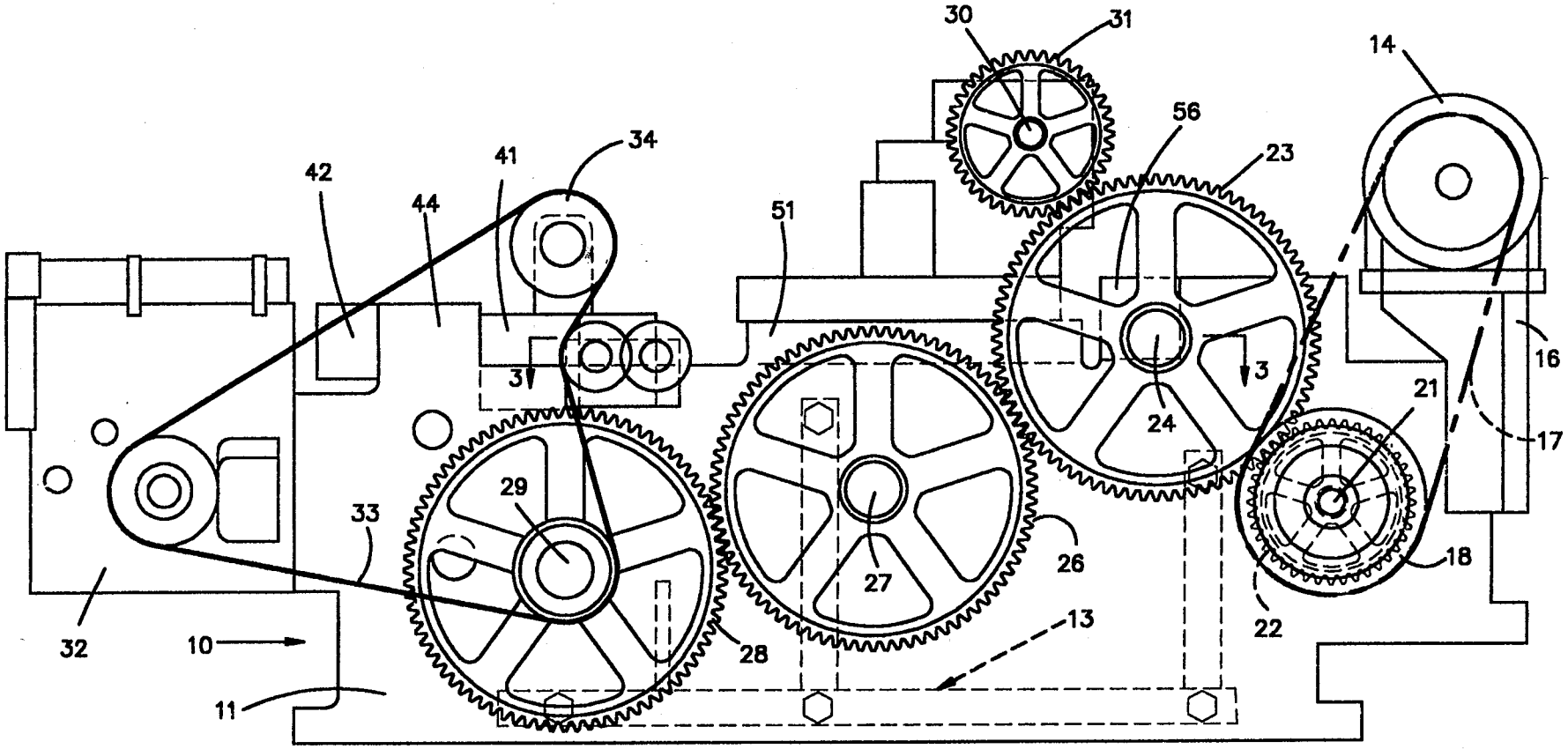
FIG. 1 is a side elevation of one side of a progressive former in accordance with one preferred embodiment of this invention.
Figure 2:
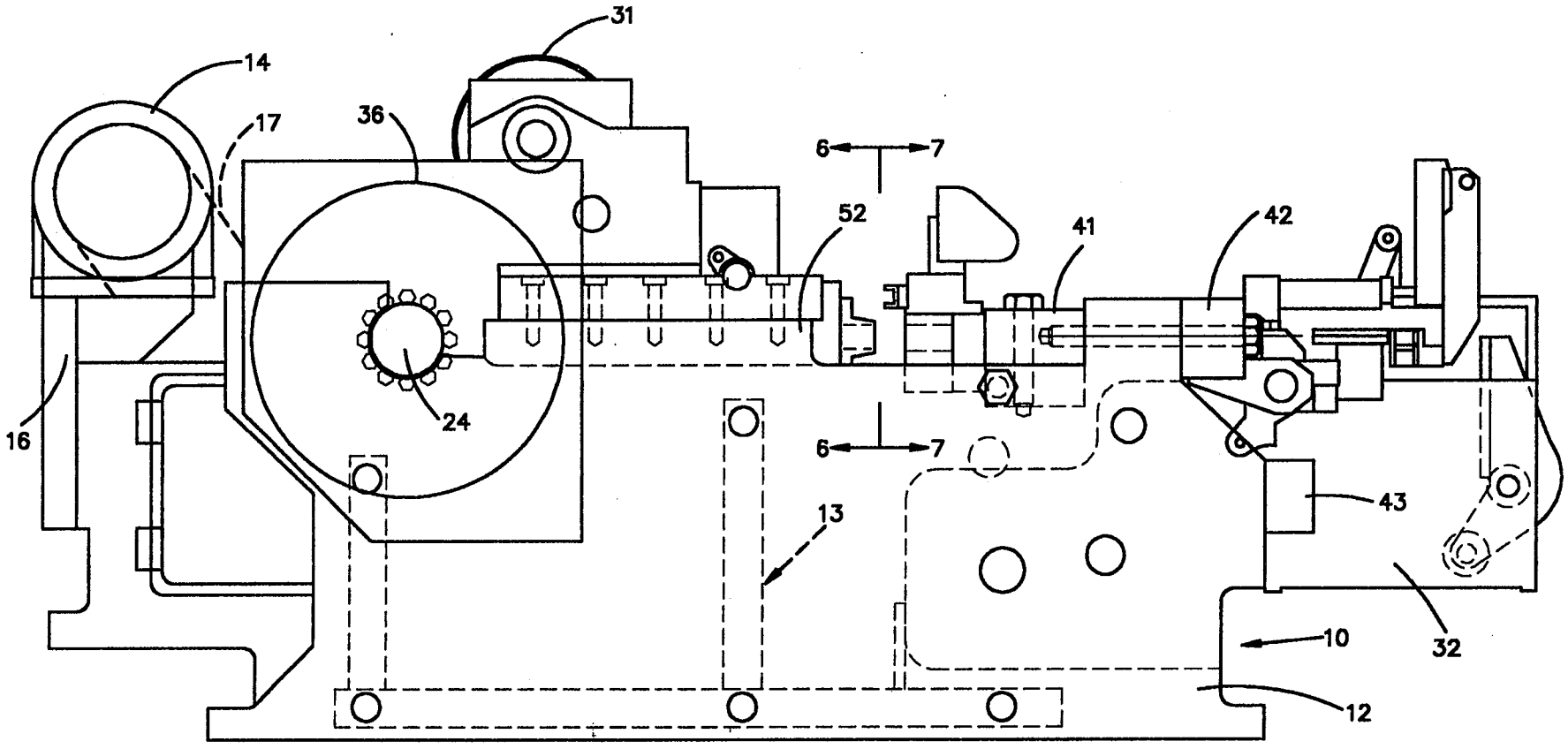
FIG. 2 is a side elevation illustrating the opposite side of the progressive former illustrated in FIG. 1.

Referring to FIGS. 1 and 2, the machine provides a frame assembly 10 fabricated from flat steel plate material. The frame assembly includes two side frame members 11 and 12 which are formed of heavy steel plate. As discussed in greater detail below, the two side frame members are interconnected and spaced apart by a spacer assembly 13, illustrated in dotted line in FIGS. 1 and 2.

Figure 5:
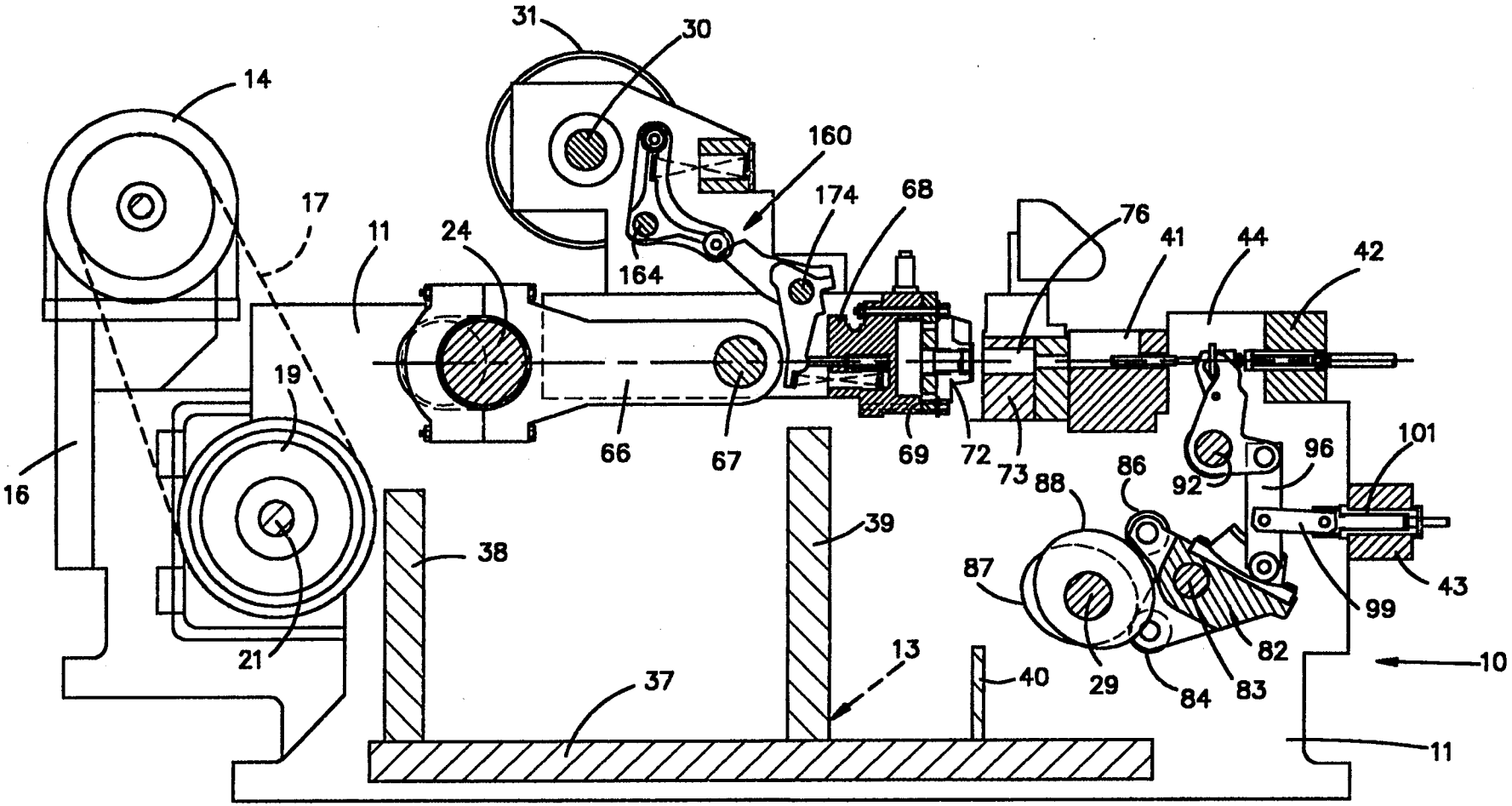
FIG. 5 is a vertical cross section of the machine, taken generally along the center line thereof, with parts removed for purposes of illustration, showing the general arrangement of the various operating components of the machine.

As best illustrated in FIG. 1, the principal components of the machine drive are mounted on the side frame member 11 and include a motor 14 mounted on a motor base 16, which is in turn mounted on the end of the side frame member 11. The motor is connected through a belt drive 17 to a clutch and flywheel assembly 18 (illustrated in FIG. 1) positioned on the outer side of the side frame member 11 and a brake 19 mounted on the opposite or inner side of the side frame member 11, as best illustrated in FIG. 5. The clutch 18 and the brake 19 are interconnected by a shaft 21 which extends through the side frame member 11. The output of the clutch 18 is provided by a gear 22 which is rotated by the motor 14 when the clutch is engaged, and is held against rotation when the clutch 18 is disengaged and the brake 19 is operated. The gear 22 meshes with a crankshaft gear 23 mounted on the end of a crankshaft 24.

An idler gear 26 is journaled on a shaft 27 on the side frame member 11, and meshes with the crankshaft gear 23, and in turn drives a camshaft gear 28 mounted on a camshaft 29. The gears 23, 26, and 28 are sized so that the camshaft 29 is driven in the same direction as the crankshaft 24, and at the same speed, so that the camshaft rotates in timed relationship to the crankshaft. Mounted on a shaft 30 is a timed knockout drive gear 31 which also meshes with the crankshaft gear 23 and is driven thereby to power the timed knockout mechanism. In this instance, the timed knockout gear has a diameter one-half the diameter of the crankshaft gear, and therefore rotates at twice the velocity thereof but in timed relationship to the rotation of the crankshaft gear and the crankshaft.

A stock feed assembly 32 is also mounted on the side frame member 11, and is driven at the same cyclic speed and in timed relationship to the camshaft 29 by a chain drive 33. The same chain drive 33 drives a transfer drive pulley 34.

This overall drive system provides a positive mechanical interconnection between all of the various operating components of the machine, and ensures that they function in timed relationship to each other. Further, all of the power inputs for the mechanism are carried by the side frame member 11. Mounted on the opposite end of the crankshaft 24 is a counterbalance 36, illustrated in FIG. 2.

Figure 4:
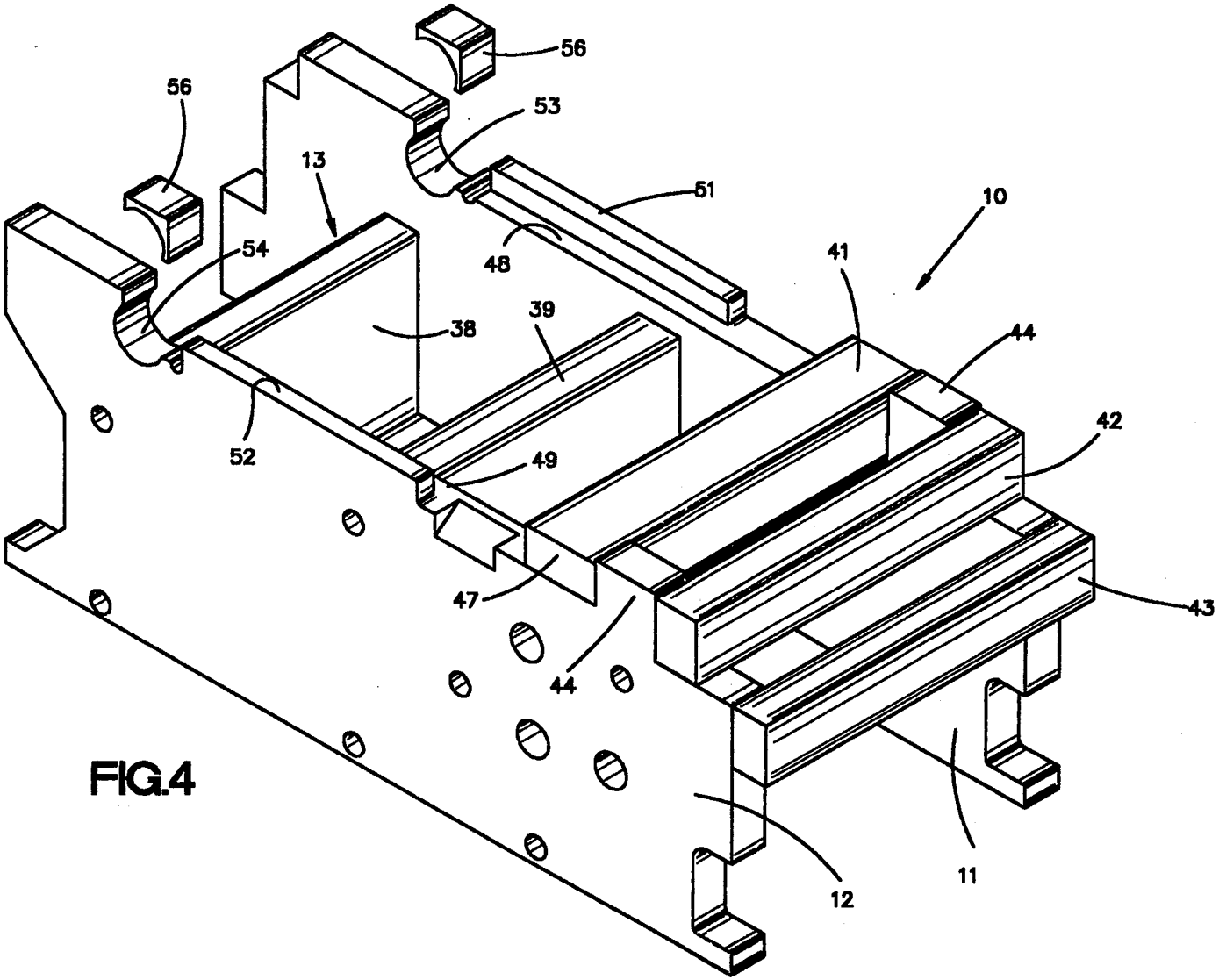
FIG. 4 is a schematic perspective view of a frame assembly for the machine of FIGS. 1 through 3 prior to the installation of the operating components on the machine.
Figure 4A:
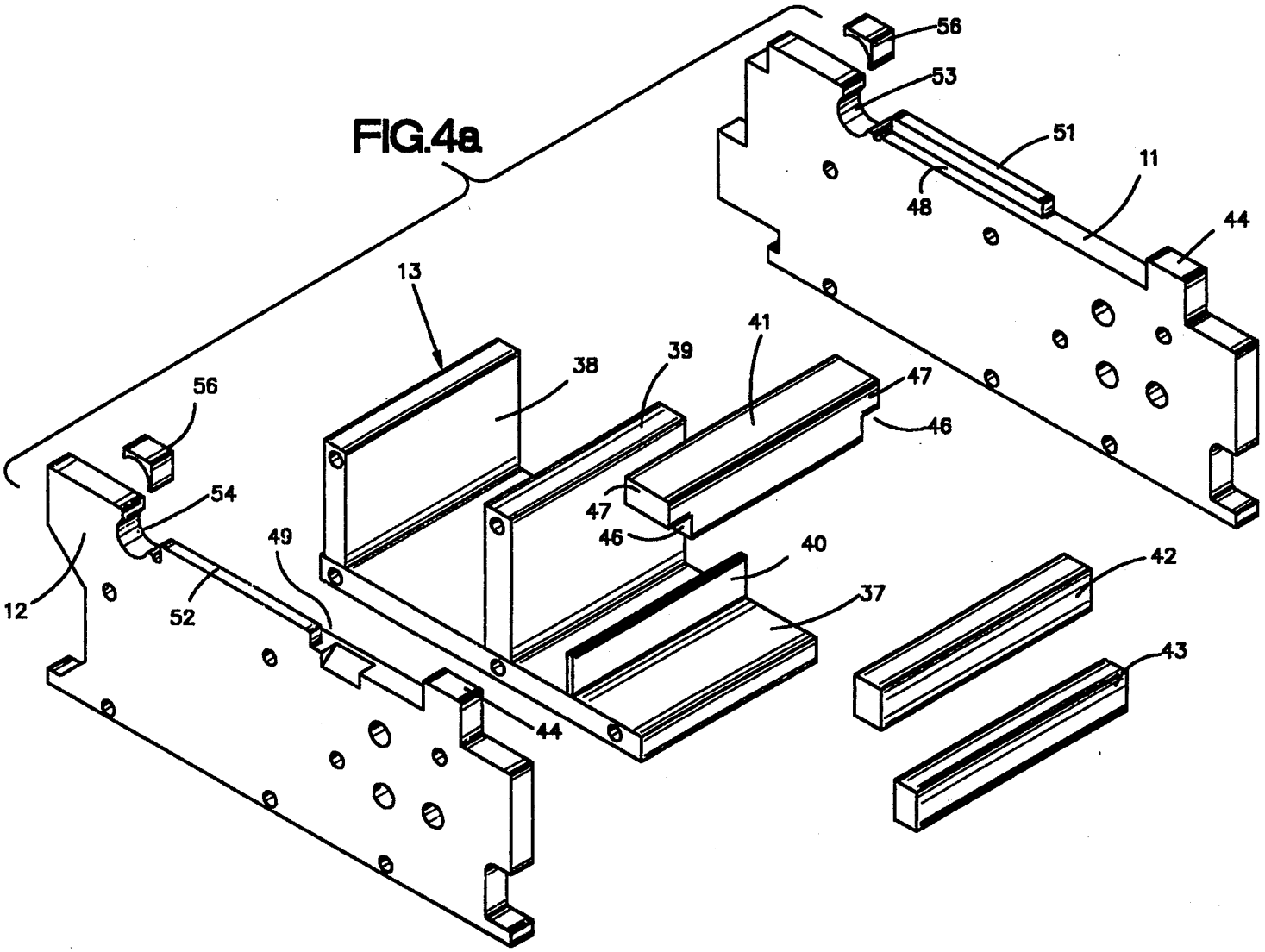
FIG. 4*a* is an exploded view of the frame assembly illustrated in FIG. 4, showing the components thereof before the frame is assembled.

The overall structure of the frame assembly 10 is best illustrated in FIGS. 4 and 4*a*. The two side frame members 11 and 12 are formed of heavy steel plate, and are interconnected by the spacer assembly 13 by bolts (not illustrated). However, within the broader aspects of this invention, the frame components could be separate castings. Similarly, if the strength requirement for the side frame members cannot be achieved with a single piece of plate material of a thickness which is commercially available, two or more pieces of plate material can be interconnected and, in effect, laminated to provide a unitary side frame member thickness great enough to meet the strength requirements. Each of the side frame members, because it is formed of a flat piece of metal, can be cut to shape and machined on conventional machine tools to very close tolerances. This is because virtually all of the required machining operations can be performed from the accessible exterior surfaces. On the other hand, with a one-piece bed frame, many machining operations must be performed from interior surfaces which are relatively inaccessible. In practice, the side frame members 11 and 12 are completely bored and machined separately before assembly so that machining of the assembled unit is eliminated. The spacer assembly 13 is also formed of heavy plate steel, and includes a base plate 37 and three upstanding plate members 38, 39, and 40 preferably welded thereto.

In a given size machine, such as a one-half inch machine, the spacer assemblies have the same shape, differing only in width. For example, in a six-work station machine, the spacer assembly is wide enough to space the two side frame members 11 and 12 apart the required distance for such number of work stations. On the other hand, if a machine is to be provided with only three work stations, the width of the spacer assembly 13 is reduced to position the two side frame members 11 and 12 closer together.

The two side frame members 11 and 12 are sized to provide sufficient strength to support the loads of a machine having the maximum number of work stations within a given size range so that the identical size frame members are be used in machines of a given size such as a one-half inch machine. It is merely necessary to change the width of the spacer assembly 13 to provide the proper spacing between the side frame members.

The frame assembly also includes a breast plate 41, an upper bed crossbar 42, and a lower bed crossbar 43, which are also bolted in place in the assembled frame.

Each of the side frame members 11 and 12 is provided with an upwardly extending projection 44. The breast plate member 41 is notched out at its ends at 46 so that the lower portion thereof extends down between the side frame members 11 and 12 in the assembled frame and to provide end projections 47 which extend over the side frame members 11 and 12 forwardly of the side frame member projections 44. These projections 47 transmit the forming loads to the side frame member projections 44. The upper bed crossbar 42 is mounted on the rearward side of the projections 44 and, as discussed in detail below, provide the support for the kick-out rod adjustment system. In order to simplify the drawings, the breast plate 41 and the two bed crossbars 42 and 43 have been illustrated without the various passages formed therein, and are merely illustrated in their overall shape and size. However, before each of them is mounted on the frame assembly, they are completely machined so that they do not have to be machined on the assembled frame.

The two side frame members 11 and 12 are also formed with lengthwise extending grooves 48 and 49 which leave an upstanding projection 51 and 52. The slide bearings are mounted along the grooves 48 and projections 49, as discussed in detail below.

The side frame members 11 and 12 are also formed of partial journals 53 and 54 for the ends of the crankshaft 24 (illustrated in FIG. 1). These journals extend through an angle of 180 degrees and cooperate with journal caps 56 when said caps are mounted to completely encircle each end of the crankshaft and provide a full journal therefor. The partial journals 53 and 54 are formed at the forward end of an upwardly extending projection along the upper edge of the side frame members and extend upwardly and forwardly along their rearward side to provide direct support for forming loads applied to the crankshaft. Therefore, the forming loads on the crankshaft are transmitted directly to the side frame member and the journal caps are not subjected to the heavy forming loads of the machine. The journal caps are bolted in place when the crankshaft is installed.

By providing journal caps and a journal structure as illustrated, it is possible to directly install the crankshaft and it is not necessary to insert it into the journals by lengthwise movement of the crankshaft, as has been required in most prior art forging machines. Consequently, this journal structure for the crankshaft simplifies the assembly of the machine and permits the use of journal bearings which are not substantially larger than the crankshaft at the journal on the shaft.

As best illustrated in FIG. 4, the entire illustrated frame assembly 10 is formed of heavy plate material and does not require any castings whatsoever. Since the cost per pound of steel plate is substantially lower than the cost per pound of castings, the cost of the frame in accordance with this invention is substantially less than the cost of a one-piece cast iron or steel frame used in heavy forging machines in the past. Currently, the cost per pound of plate is approximately 25% to 30% of the cost per pound of a cast iron frame. Therefore, even though the frame provided in accordance with this invention will often be heavier than conventional cast iron frames, the total cost of the frame is substantially lower. Further, the fact that the frame is heavier in most instances provides the advantage of reducing vibration and balancing problems, so the additional weight is not a disadvantage.

Further, because the various components of the frame assembly are flat, or substantially flat, they can be machined with greater accuracy and at lower cost by conventional machine tools on which the frame component can be mounted during the machining operations. Additionally, because the side frame members which are the principal components of the frame assembly are identical in machines having different numbers of work stations, it is economically feasible to produce such components in sufficient numbers to realize machining economies and then inventory the frame members for assembly when orders for specific machines are received.

In instances in which some or all of the frame components are formed of castings, similar savings are realized, since such component castings are less complex and smaller than one-piece frame castings, and are more economical to produce and machine.

This invention drastically reduces the necessary lead time for the manufacture of machines, particularly when plate steel which is readily available is used. Such plate steel does not involve significant delays previously encountered before a one-piece cast iron frame was available for machining. Even when some or all of the frame components are formed as castings, lead time is reduced because it is economically feasible to produce such components for inventory.

Figure 3:
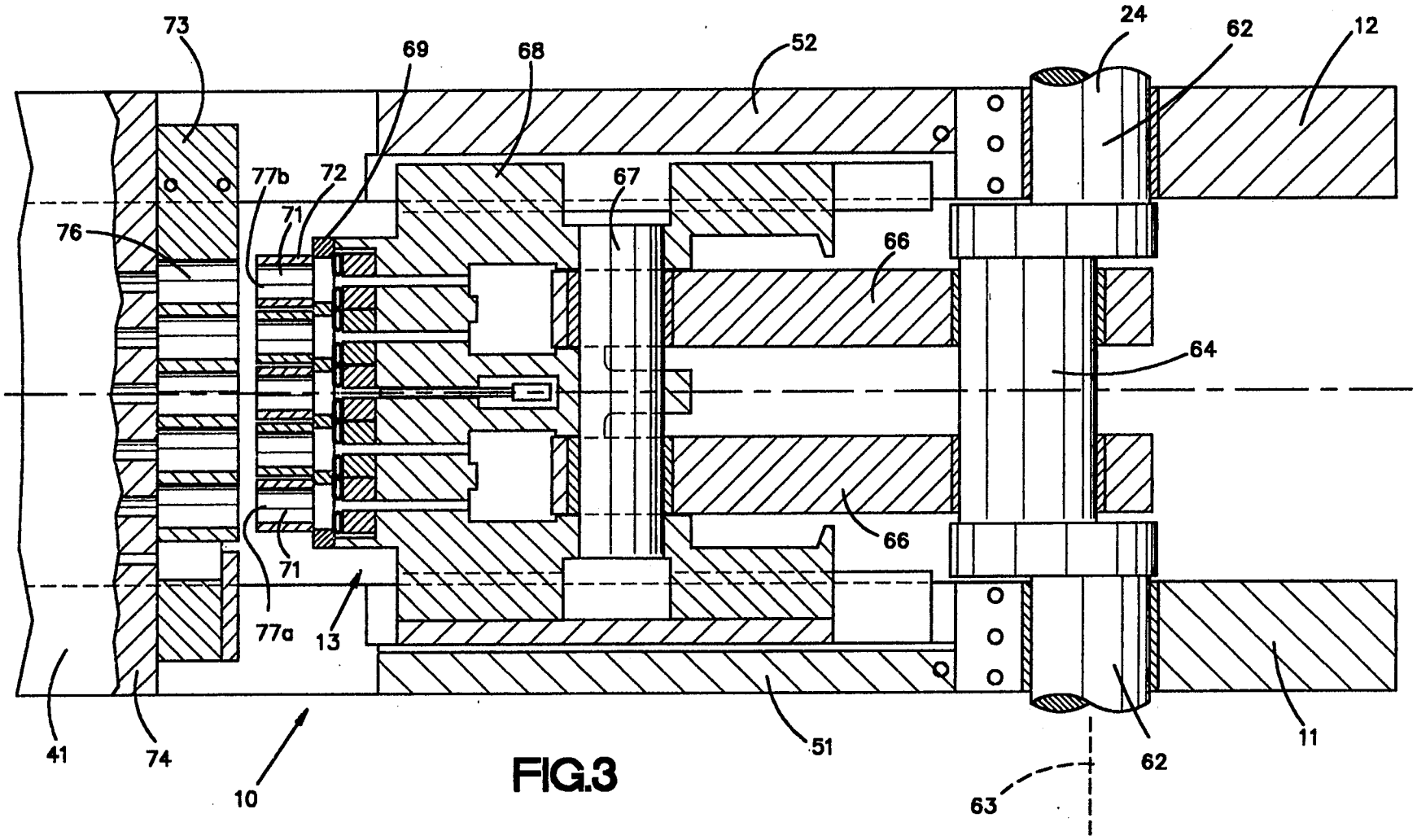
FIG. 3 is a fragmentary, horizontal section taken generally along line 3—3 of FIG. 1, with parts removed for purposes of illustration, and showing the general arrangement of the tooling system and the slide drive.

Reference should now be made to FIGS. 3 and 5, which illustrate the principal operating systems of the machine. In these figures, tooling has not been illustrated, and many of the detailed parts have not been illustrated in order to simplify the drawings and promote a better understanding of the overall machine.

The crankshaft 24 is provided with journal portions 62, which are journaled in the two side frame members 11 and 12 for rotation about an axis 63. Intermediate the journals, the crankshaft is provided with an eccentric journal portion 64 on which a pair of laterally spaced pitmans 66 are journaled. The opposite ends of the pitmans 66 are journaled on a wrist pin 67 which connects the pitmans to a header slide 68. Rotation of the crankshaft 24, therefore, produces reciprocation of the header slide 68 between a forward dead center position and a rearward dead center position. In FIGS. 3 and 5, the header slide is illustrated in the forward dead center position.

Mounted on the face of the header slide 68 is a punch block 69 on which a tool holder 72 is removably mounted. The tool holder is provided with openings 71 in which the reciprocating tooling (not illustrated) is mounted.

A die breast 73 and backup plate 74 are mounted on the frame assembly 10 against the forward face of the breast plate 41. Here again, the dies are not illustrated, but would normally be mounted in the die openings 76 in the die breast 73.

The stroke of the header slide 68 is equal to twice the eccentricity of the eccentric journal portions 64 on the crankshaft 24. In accordance with this invention, the frame assembly 10 and the header slide 28 are identical in similar machines which have different header slide strokes. If a short stroke machine is required, the crankshaft is provided with less eccentricity in the eccentric journal portion 64 and the pitmans 66 are made longer to compensate for the reduced eccentricity. Consequently, the slide reaches the same forward dead center position in machines of short stroke and long stroke, but the back dead center position of the header slide is further back from the die breast 73 in long stroke machines and closer to the die breast 73 in short stroke machines. Here again, by standardizing the principal parts of the machine and varying the stroke merely by changing the eccentricity of the crankshaft 24 and the length of the pitmans 66, it is not necessary to provide special frame assemblies for different stroke lengths within a given machine size. Again, the standardization permits economies of manufacture and reduces the manufacturing costs of the machine.

FIG. 3 illustrates a five-station machine in which workpieces are progressively worked in five operations. The two pitmans 66 are spaced apart a distance so that the center lines of the outermost work stations **77*a* and 77*b* are in direct alignment with the associated pitman 66. Therefore, the working loads at the various work stations are transmitted directly back through the pitmans 66** and the header slide is therefore not subject to eccentric forces which would tend to cause the header slide to cant out of alignment.

When a similar machine is produced having a lesser number of work stations 77, the two side frame members 11 and 12 are spaced a smaller distance apart. However, the spacing of the pitmans 66 is still arranged to provide alignment with the center lines of the outermost work stations 77*a* and 77*b* to prevent the working forces from being eccentric with respect to the pitman system. In machines having two or three work stations, it may be impractical to use two pitmans, but even in such machines the width of the pitman is selected so that the working loads are not eccentric with respect to the pitman.

Figure 8:
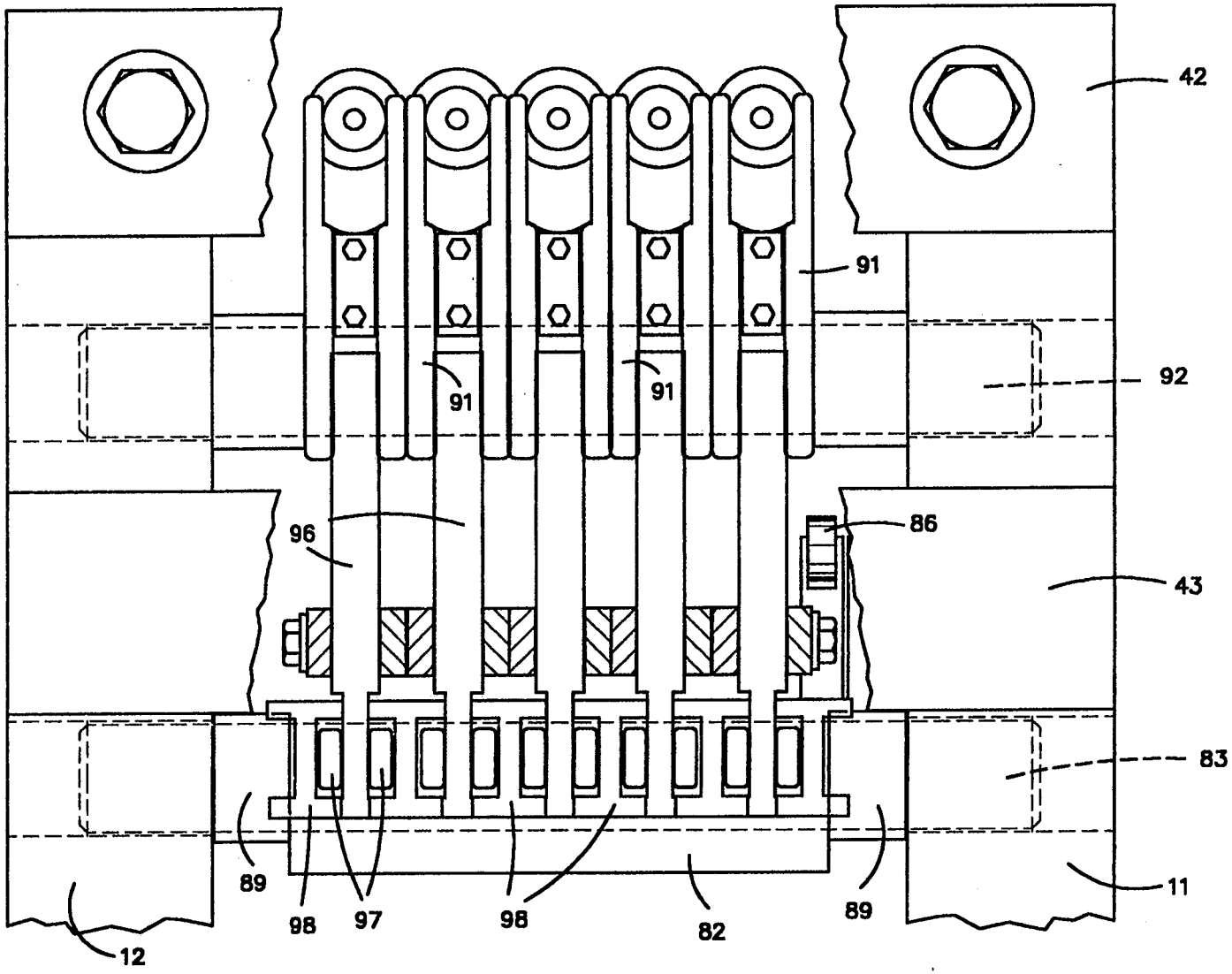
FIG. 8 is a fragmentary, lateral cross section, illustrating the kickout drive of the machine.
Figure 9:
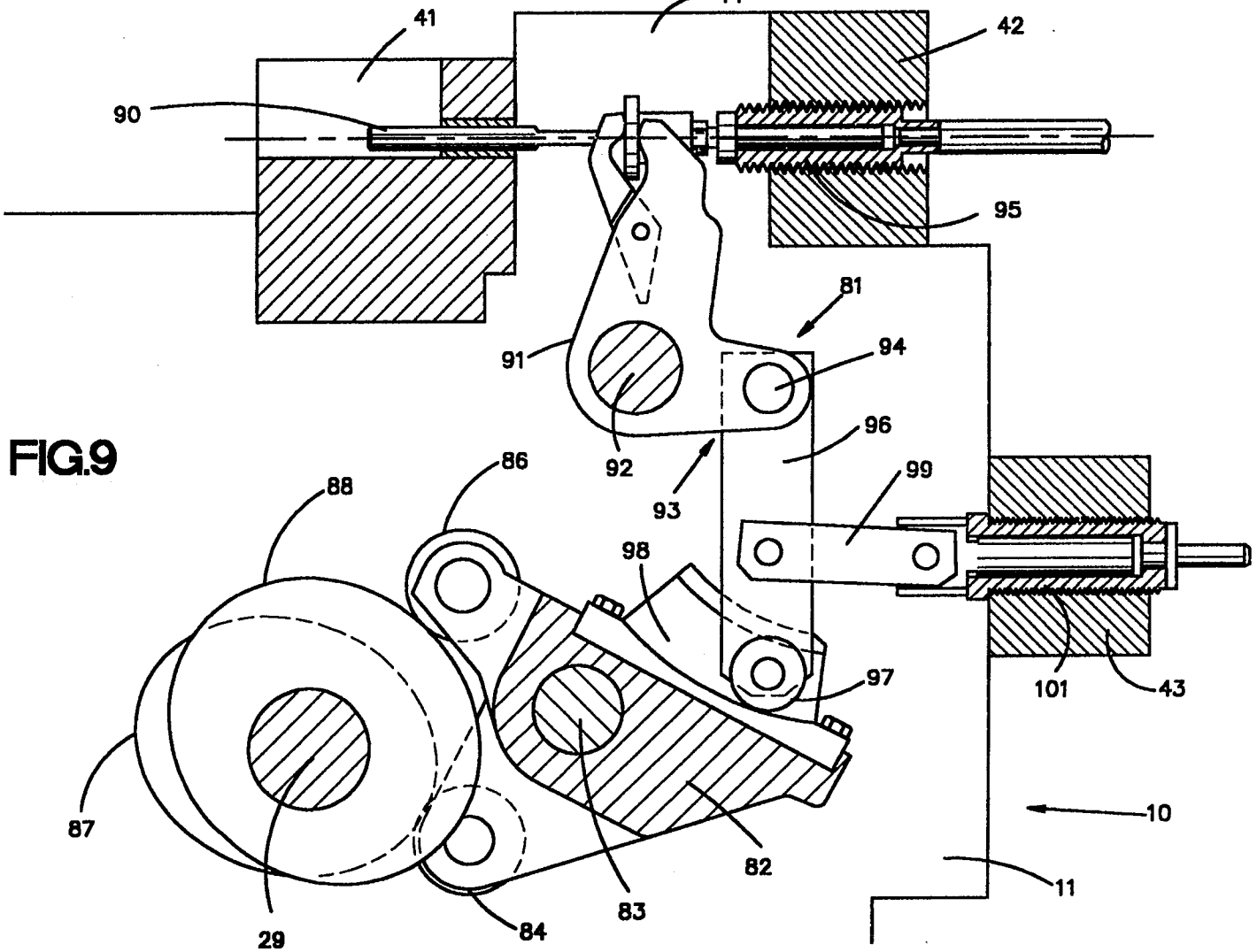
FIG. 9 is an enlarged, fragmentary view of the kick-out linkage which operates to eject workpieces from the dies in the die breast.

Referring to FIGS. 5, 8, and 9, a kickout drive 81 is provided for each work station. Each of the kickout drives 81 is identical to the other kickout drives at the other stations, so economies of manufacture are again achieved. In a five-station machine, five kickout drives 81 are provided. However, all of the kickout drives are powered by a single rocker arm 82 which is journaled on a shaft 83 supported at its ends in the two side frame members 11 and 12. The rocker arm is oscillated back and forth by a pair of cam followers 84 and 86 which respectively engage a pair of cams 87 and 88 mounted on a camshaft 29. Therefore, a single cam system including the two cams 87 and 88 functions through a single rocker arm 82 to power all of the individual kickout drives 81.

As best illustrated in FIG. 8, the rocker arm 82 extends substantially across the machine and is centered within the machine by spacers 89 between its ends and the two side frame members 11 and 12. In this figure, the cam follower 86 is illustrated at one end of the rocker arm, but it is within the scope of this invention to locate the cams and the cam followers at other positions along the length of the rocker arm 82.

The length of the rocker arm 82 is selected to correspond to the number of work stations in the machine. However, it is preferred that if, for example, a range of machines having from two to six work stations is to be provided in a particular machine size, rocker arms are produced having a length to accommodate six work stations and four work stations. In the event that a five-work station machine is required, it is merely necessary to cut off the end of a six-work station machine rocker arm 82 from inventory and assemble the thus-shortened rocker arm in a five-station machine. Similarly, if machines having less than four work stations are required, a rocker arm 82 having a length for a four-station machine is merely cut off to accommodate the smaller number of work stations. In this way, substantial material losses are not involved, even though only two basic rocker arm sizes are manufactured for the full range of work stations for a given size of machine.

Each of the kickout drives 81 is provided with a rocker arm 91 journaled on a cross shaft 92 for oscillating rotation. One arm 93 of the rocker arm 91 is pivotally connected at 94 to a drive link 96 having a pair of coaxial roller followers 97 journaled on its lower end.

As best illustrated in FIG. 8, each of the roller followers is positioned within an associated track member 98 bolted to the rocker arm 82. Also connected to the drive link 96 intermediate its ends is a second drive link 99 which permits adjustment of the stroke or the angle of oscillating rotation of the rocker arm 91 and, in turn, the stroke of the kickout drive 81. The second drive link 99 is pivotally connected to an adjusting screw 101 mounted in the lower bed crossbar 43.

By individually adjusting the second drive link 99 in and out by rotating the adjusting screw 101, the stroke of the individual kickout drive can be adjusted without requiring any change in the cams 87 and 88 or any adjustment in the angle of rotation of the rocker arm 82. Here again, however, since all of the components of the kickout drive 81 are identical for a given machine size, it is economically feasible to manufacture such components for inventory and then assemble them in any machine of a given size, regardless of the number of work stations involved. Therefore, more economical larger production runs can be utilized for the manufacture of such components.

When the kickout drive 81 is operated, the anticlockwise rotation of the rocker arm 91 operates to move the ejector pin 90 to the left, as viewed in FIG. 9, to eject workpieces from the associated die. An adjustable backup screw 95 is threaded into the crossbar 42 to absorb forming loads on the ejector pin and prevent forming loads from being transferred to the kickout mechanism 81.

Preferably, the adjustment screw 101 and the backup screw 95 are connected for co-rotation by a chain drive or the like (not illustrated) so that they can be correspondingly adjusted to adjust the rearward position of the ejector pin 90. The linkage of the kickout drive and the track members 98 are structured so that adjustment of the screw 101 produces linear adjustment of the position of the upper end of the rocker arm 91 so that the adjustment of the two screws 95 and 101 produces corresponding adjustment of the kickout drive and of the backup screw.

Figure 6:
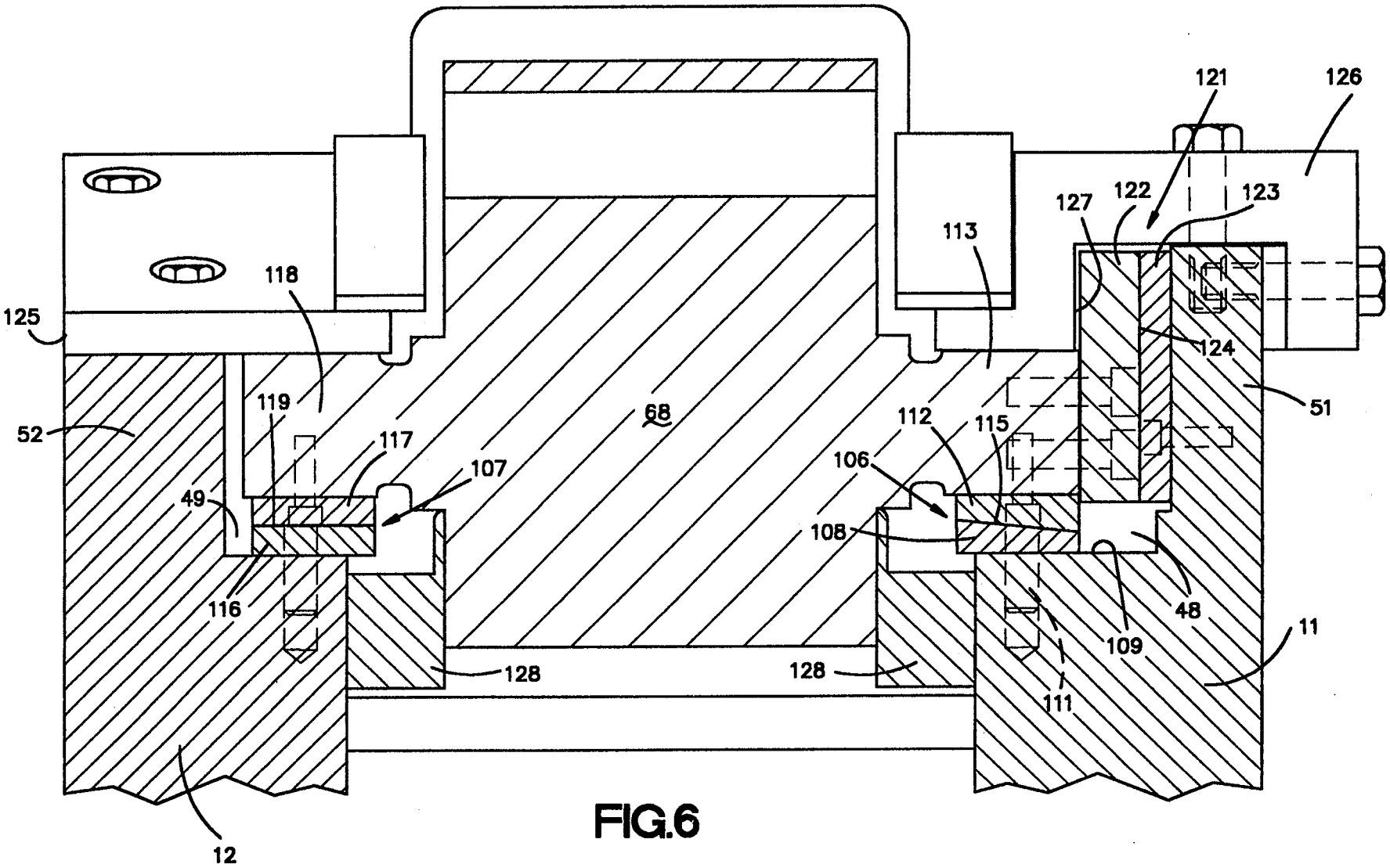
FIG. 6 is a fragmentary, lateral cross section, with parts removed for purposes of illustration, showing the bearing system for supporting the slide within the frame.

The bearing support system for the header slide 68 is best illustrated in FIG. 6. The vertical support for the header slide is provided by a first bearing assembly 106 on the side frame member 11, and a second bearing assembly 107 on the side frame member 12. The first bearing assembly 106 includes an elongated, stationary bearing member 108 supported on a horizontal support surface 109 provided by the groove 48. Locating pins 111 project from the side frame member 11 into the bearing member 108 to fix the bearing member 108 in position and prevent movement thereof .relative to the side frame member 11. An upper bearing member 112 mounted on a wing 113 of the slide 68 engages the upper surface of the bearing member 108 and permits reciprocating movement of the slide along the bearing member 108. The two bearing members 108 and 112 are formed with an outwardly and downwardly extending interface 115 so that the weight of the slide supported by the bearing assembly 106 creates a bias tending to move the slide in a direction to the right, as illustrated in FIG. 6. The bearing assembly 107 on the opposite side of the slide 68 includes a fixed bearing member 116 mounted on the side frame member 12 and an upper movable bearing member 117 mounted on the wing 118 of the slide 68. In this instance, however, the interface 119 between the two bearing members 116 and 117 extends in a horizontal direction so that the weight supported by the bearing assembly 107 does not produce any lateral bias on the slide.

The lateral position of the slide 68 is established by a bearing assembly 121 on one side of the slide. This assembly includes a vertically extending bearing plate 122 bolted to the wing 113 and a stationary bearing plate 123 bolted to the projection 51 of the side frame member 11. These two bearing plates provide an interface 124 which prevents movement of the slide to the right beyond the position illustrated in FIG. 6. A C-shaped bearing member 126 is bolted to the projection 151 and provides a downwardly extending bearing portion 127 which embraces the opposite side of the bearing plate 122 and ensures that the slide does not move to the left from the position illustrated. A very small running clearance is provided between the downwardly extending bearing surface 127 and the bearing plate 122. However, because a lateral bias toward the bearing plate 123 is provided by the inclined interface 115 of the bearing assembly 106, the running clearance is normally maintained at the bearing surface 127. With this structure, in which a bias is provided to maintain engagement at the interface 124, very accurate lateral positioning of the slide is provided.

Further, since the lateral guiding of the slide 68 is provided only on the side frame member 11, any tolerance variation in the spacing between the two side frame members 11 and 12 does not in any way adversely affect the lateral positioning of the slide. In fact, a relatively large clearance is provided between the projection 52 of the side frame member 12 and the slide wing 118. Further, this structure for laterally positioning the slide eliminates lateral positioning inaccuracy created by thermal expansion of the bed frame or by load-induced frame deflections. One side of the slide 68 is held down by engagement of the upper surface of the wing 113 and the bearing member 126 and the other side of the slide 68 is held down by engagement between the wing 118 and a bearing cap 125.

In order to entrap lubricants, a pair of wiper members 128 are mounted on the associated of the side frame members 11 and 12 and are shaped to provide a trough along which lubricant flows to a reservoir return. A small running clearance is provided between these wiper members 128 and the adjacent portions of the slide, and such members do not provide any bearing function but merely function as a lubricant retainer.

Figure 7:
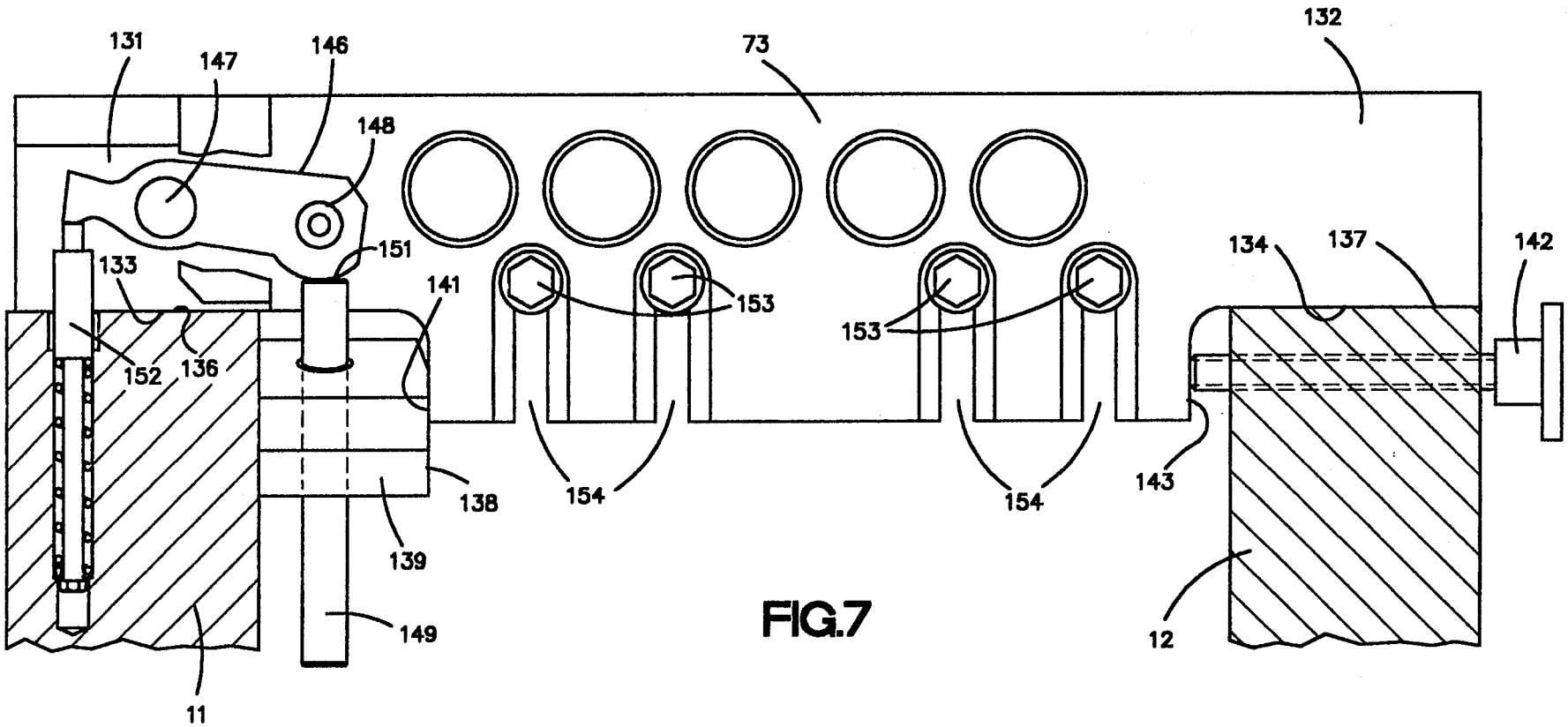
FIG. 7 is a fragmentary, lateral section illustrating the mounting of the die breast in the machine.

The mounting of the die breast 73 is best illustrated in FIG. 7. The die breast is removably mounted on the frame assembly to permit quick tool changes.

The die breast 73 is provided with lateral extensions 131 and 132 having lower surfaces 133 and 134, respectively, which rest on accurately machined surfaces 136 and 137 on the two side frame members 11 and 12, respectively. Clamping bolts 135 may be provided which extend through the wing portions 131 and 132 to clamp the die breast tightly against the surfaces 136 and 137 to establish the vertical position of the die breast with respect to the frame.

Lateral position of the die breast is provided by engagement between a surface 138 on a block 139 secured to the side frame member 11 and a mating surface 141 on the die breast. The block 139 is permanently mounted on the side frame member 11 and its surface 138 is accurately machined prior to the assembly of the frame assembly.

A locating screw 142 is threaded through the side member 12 and engages a vertical surface 143 on the die breast to ensure that the two surfaces 138 and 141 on the opposite side of the die breast are pressed into engagement. Therefore, the lateral positioning of the die breast is determined solely by the side frame member 11 and tolerances in the spacing between the two side frame members 11 and 12 do not affect in any way the lateral position of the die breast. Since the slide and the die breast are laterally located solely by the side frame member 11, accurate lateral positioning of the slide and die breast relative to each other is ensured.

A cutter arm 146 is journaled on the die breast by a pivot 147 and provides a tubular cutter 148 through which a predetermined length of wire stock or rod stock is fed by the stock feed assembly 32 illustrated in FIG. 2. After the stock has been fed into the cutter 148, a cutter drive pin 149 is raised by a cam (not illustrated) on the camshaft 29, causing the cutter to be raised up as viewed in FIG. 7. This shears a workpiece from the end of the stock, which is subsequently transferred to the various work stations where it is progressively formed.

The upper surface 151 of the cutter drive pin 149 is accurately machined so that the cutter arm 146 will be accurately positioned when the die breast is installed on the machine frame. With this structure, the cutter and the dies are carried by the die breast and removed with the die breast when the die breasts are changed. A spring-loaded pin 152 mounted on the side frame member 11 engages the opposite end of the cutter arm 146 and maintains the cutter arm in engagement with the cutter drive pin 149.

A plurality of bolts 153 are threaded into the breast plate 41 through vertically extending slots 154 formed in the die breast, and function to clamp the die breast tightly against the die breast plate 41.

Figure 10:
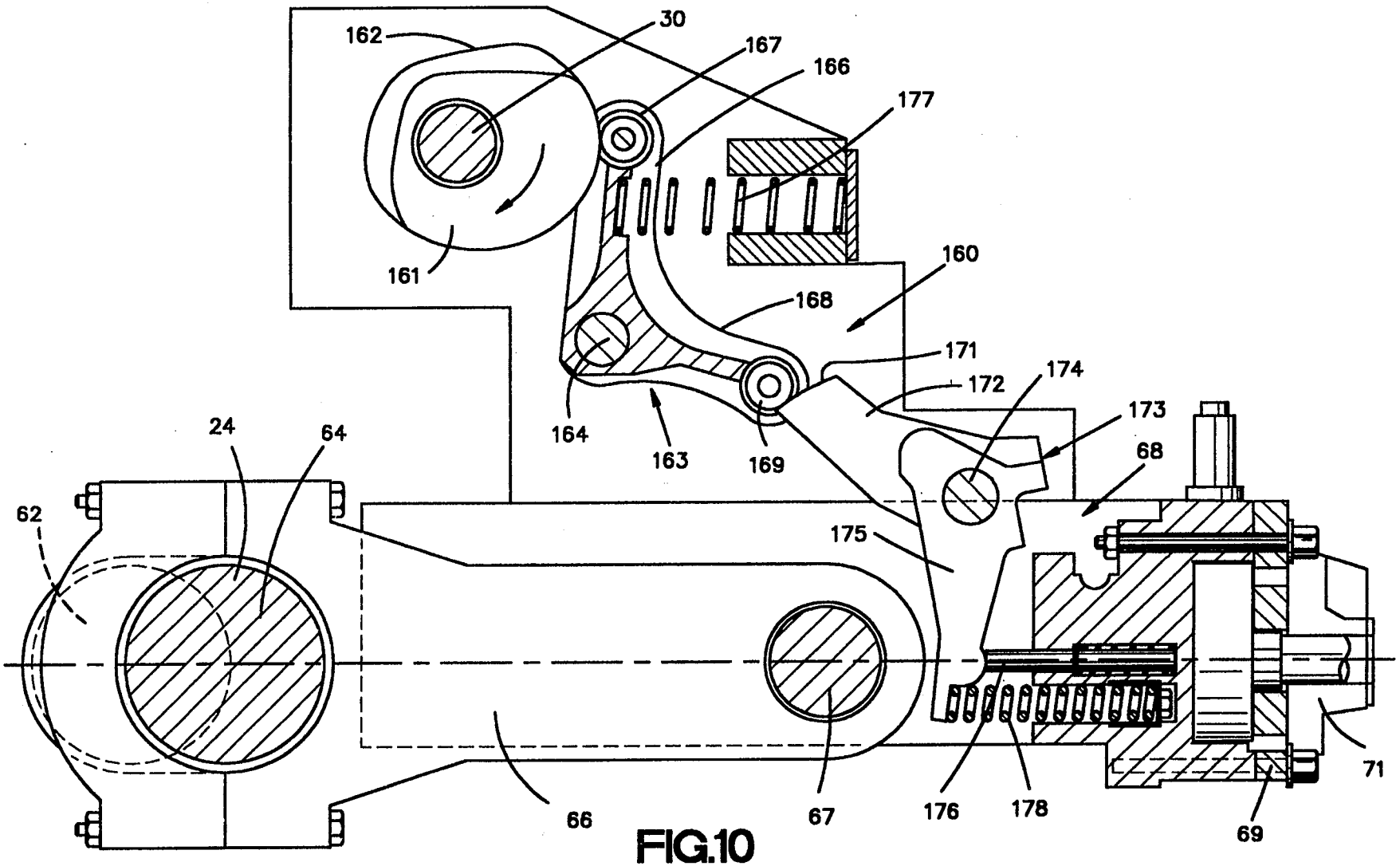
FIG. 10 is an enlarged, fragmentary view illustrating the linkage for the timed knockout which ejects workpieces from the tooling on the slide.

A timed kickout drive 160 for ejecting workpieces from the reciprocating tooling carried by the slide 68 is best illustrated in FIGS. 5 and 10. This drive includes a pair of cams 161 and 162 mounted on the shaft 30 at each work station where a timed kickout is required. Associated with each pair of cams 161 and 162 is a rocker arm 163 pivotally mounted on a cross shaft 164. One arm 166 of the rocker arm 163 is provided with a roller follower 167 which engages the two cams 161 and 162. The cams are shaped to oscillate the rocker arm 163 between an operative position illustrated in FIG. 10 and a retracted position in which the rocker arm 163 has rotated in an anticlockwise direction from the illustrated position.

The other arm 168 of the rocker arm 163 is provided with a roller 169 which engages a cam surface 171 formed on one arm 172 of a rocker arm 173. The rocker arm 173 is pivoted on a shaft 174 carried by the slide 68 and moves back and forth with the slide as the slide reciprocates within the frame. The other arm 175 engages the rearward end of an ejector pin 176 which, when extended, ejects the workpiece from the tooling carried by the slide. A first spring 177 normally maintains the roller 167 in engagement with an associated cam 161 and 162, and a second spring 178 biases the rocker arm 173 in a clockwise direction.

The two cams 161 and 162 are both provided with dwell portions which maintain the first rocker arm 163 in the operative position illustrated as the slide 68 commences to retract from its forward dead center position. Since the rocker arm 173 is journaled on the slide and moves with the slide as it retracts, the cam surface 171 moves relative to the roller 169 and produces anticlockwise pivotal movement of the second rocker arm 173 as the slide commences to retract from the forward dead center position. The cam surface 171 is shaped so that as the slide commences to retract, the ejector pin 176 extends and prevents the workpiece from being carried by the tooling on the slide as the slide retracts.

When the desired amount of extension of the ejector pin 176 relative to the slide tooling has occurred, the dwell portions on the cams 161 and 162 rotate beyond the roller 167, allowing the first rocker arm 163 to move in an anticlockwise direction out of engagement with the cam surface 171 to prevent further movement of the ejector pin 176.

The cam 161 is fixed against rotation relative to the shaft 30 and the cam 162 is mounted for limited rotational adjustment relative to the cam 161 and, in turn, the shaft 30. This permits individual adjustment of the amount of movement of the associated ejector pin 176. For example, if the cam 162 is rotated relative to its associated cam 161 in a clockwise direction, the dwell period is reduced and the first rocker arm moves to its retracted position at an earlier point in the machine cycle. On the other hand, if a greater amount of movement of the ejector pin is required, the cam 162 is rotated relative to its associated cam 161 in an anticlockwise direction to extend the dwell period of the cam.

Here again, an identical linkage is provided at each work station where a tooling ejection system is required. Therefore, if only two ejection systems are required, only two linkage systems are provided. If more than two stations are provided which require additional ejection mechanisms, additional identical ejection systems are installed. Because identical components are provided in a given size of machine, it is practical to manufacture for inventory and obtain manufacturing economies as a result. Further, individual adjustment of the individual ejection mechanisms at each die station are provided by merely adjusting the associated cam 162 relative to the associated cam 161.

In the illustrated embodiment, the shaft 30 rotates through two revolutions during each machine cycle. This permits the use of a smaller timed knockout drive gear 31, and therefore provides a more compact machine structure. The fact that each of the cams 161 and 162 rotates through two complete revolutions during each cycle of the machine does not present any problem. Because of the rotational velocity of the cams, the rocker arm 163 moves to its extended or operative position twice during each machine cycle. However, one of such movements to its operative position occurs while the slide is located substantially at its back dead center position and in such position the cam surface 171 of the rocker arm 173 is spaced back from the associated roller 169, and is therefore not operated. The operation of the cams 161 and 162 provides another advantage in that the cams do not have to be provided with steep camming surfaces to provide rapid retraction of the rocker arm 163 at the end of the timed kickout operation.

In accordance with the present invention, the slide on which the tools are mounted and the die breast are located at the top of the frame assembly. The frame assembly provides, in effect, an open C-shaped structure. Consequently, the tooling is accessible and quick changes of tooling are easily performed. On the other hand, in most prior art machines utilizing castings for the bed frame, the die breast and the slide have been mounted down in the bed frame itself in a less accessible location.

In accordance with this invention, the number of castings and of different component parts that must be produced is drastically reduced. This results in substantial reductions in costs of manufacture and substantial reductions in the lead time required for the manufacture of a particular machine. Because of the duplication of components in different machines, it is economically feasible to manufacture substantial numbers of the various components for inventory, thereby permitting more efficient, lower cost manufacturing techniques. Further, because the frame is an assembly of substantially flat component parts, the various components of the frame can be manufactured and machined to greater accuracy and at lower cost.

Although the preferred embodiment of this invention has been shown and described, it should be understood that various modifications and rearrangements of the parts may be resorted to without departing from the scope of the invention as disclosed and claimed herein.

What is claimed is:

1. A progressive forging machine having a number of work stations and comprising a bed frame, a slide reciprocable on said bed frame, and a die breast mounted on said bed frame, the slide and die breast having a lateral position with respect to said frame, said bed frame including two side frame portions and a spacer portion, said side frame portions being mounted on opposite sides of said spacer portion and cooperating therewith to laterally space said side frame portions and to provide said bed frame, the lateral position of said slide and die breast being determined solely by one of said side frame portions independent of tolerance variations in the spacing between the side frame portions and changes in the spacing of said side frame portions created by thermal expansion.

2. A machine as set forth in claim 1, including a drive to reciprocate said slide, said drive being mounted on said one side frame portion independent of the other side frame portion.

3. A machine as set forth in claim 2, wherein said machine includes a stock feed mounted on said one of said side frame portions independent of the other side frame member.

4. A machine as set forth in claim 1, wherein said spacer portion has a width selected to correspond with the number of work stations provided by said machine.

* * * * *